US005090829A

United States Patent [19]

Lee et al.

[11] Patent Number: 5,090,829

[45] Date of Patent: Feb. 25, 1992

[54] METHOD AND APPARATUS FOR MONITORING PRINT HEAD CARRIAGE

[75] Inventors: James W. Lee, Groton; Michael A. Ditonto, Cortland; Dale W. Roddy, Candor, all of N.Y.

[73] Assignee: NCR Corporation, Dayton, Ohio

[21] Appl. No.: 642,499

[22] Filed: Jan. 17, 1991

[51] Int. Cl.[5] ..... B41J 29/42; B41J 29/38

[52] U.S. Cl. ..... 400/705.1; 400/322; 400/705.3; 340/686

[58] Field of Search ..... 400/705, 705.1, 705.2, 400/705.3, 705.4, 705.5, 706, 322; 340/686

[56] References Cited

U.S. PATENT DOCUMENTS

| | | | |
|---|---|---|---|
| 3,970,183 | 7/1976 | Robinson | 400/124 |
| 4,072,893 | 2/1978 | Huwyler | 324/208 |
| 4,305,674 | 12/1981 | Velazquez | 400/124 |
| 4,348,625 | 9/1982 | Sharp | 318/757 |
| 4,461,587 | 7/1984 | Schöttle | 400/131 |
| 4,518,272 | 5/1985 | George | 400/705.1 |
| 4,687,361 | 8/1987 | Kikuchi | 400/322 |
| 4,898,487 | 2/1990 | Brull | 400/354 |

FOREIGN PATENT DOCUMENTS

| | | | |
|---|---|---|---|
| 2915027 | 10/1980 | Fed. Rep. of Germany | 400/705.1 |
| 80915 | 1/1980 | Japan | 400/705.1 |
| 87983 | 6/1982 | Japan | 400/705.1 |
| 40280 | 3/1985 | Japan | 400/705.1 |

OTHER PUBLICATIONS

IBM Tech. Disclosure Bulletin, vol. 26, No. 7A, Dec., 1983, "Adaptive Braking Routine . . . ".

IBM Tech. Disclosure Bulletin, vol. 32, No. 1, Jun., 1989, "Print Head Calibration . . . ".

*Primary Examiner*—Edgar S. Burr

*Assistant Examiner*—Eric P. Raciti

*Attorney, Agent, or Firm*—Killworth, Gottman, Hagan & Schaeff

[57] ABSTRACT

A print head carriage of an impact printer is monitored by means of a segmented timing member which is separate from but coupled to and movable in coordination with the carriage. The segmented timing member is associated with a carriage drive motor and preferably comprises a toothed wheel which is rotated by a motor drive gear also used to move the print head carriage. The teeth of the toothed wheel are monitored by an optical sensor with a resulting series of pulses being accumulated to define the rotation of the toothed wheel and thereby the movement and position of the print head carriage. A home carriage position is directly indicated via a carriage position indicating member which is operated by the print head carriage to interrupt the optical sensor of the preferred embodiment.

25 Claims, 2 Drawing Sheets

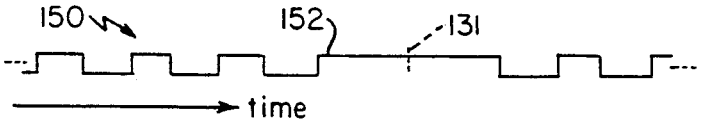
FIG-5
FIG-1
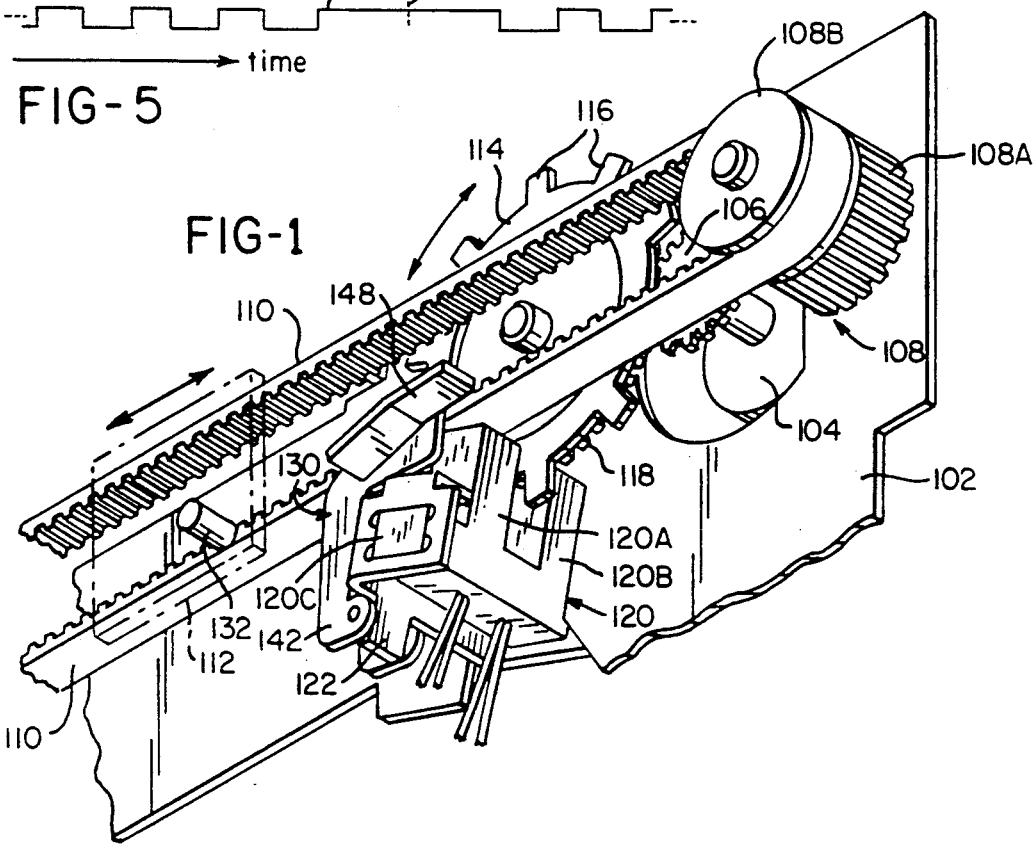
FIG-2
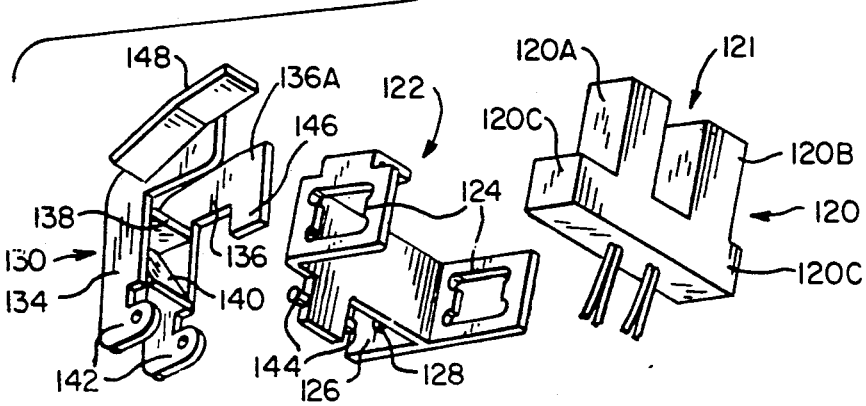

METHOD AND APPARATUS FOR MONITORING PRINT HEAD CARRIAGE

BACKGROUND OF THE INVENTION

The present invention relates generally to printers which utilize a print head carriage to print characters and, more particularly, to a method and apparatus for monitoring movement of the print head carriage to efficiently and accurately control such printers.

In the field of printing, the most common type printer has been the printer which impacts a record media which is stepped through the printer in a line-by-line motion as lines of print are formed on the media. The impact printing operation depends upon the coordinated movement of impact members, such as print hammers, wires or the like which are supported upon a print head, and a print head carriage which supports the print head and is moved back and forth across the record media. Movement of both the impact members and the print head carriage are controlled by electromechanical drive systems which enable their precise control.

To increase the printing speed and performance of printers, the size of the printing elements, the print head and the print head carriage have been continually reduced such that they can be moved and controlled more rapidly and accurately. In addition to the size of the printing elements and print head per se, the method and apparatus used to monitor the position of the print head can influence the operation of a printer. For example, the mass of the print head is typically increased by the apparatus used to monitor its position.

U.S. Pat. No. 4,898,487 discloses a print head carriage for a matrix printer wherein an optical sensor is mounted directly onto the print head carriage and moved along with the carriage. The optical sensor is used to monitor teeth of a comb-like timing strip which forms a portion of the printer frame and is positioned such that its teeth extend into the optical sensor. In this way, as the print head carriage is moved back and forth across the record media, a series of pulses is produced. The pulses cumulatively represent the position of the print head carriage and are monitored to control the printer. The ends of the timing strip are not toothed such that they define home positions on either side of the printer.

While the print head carriage monitoring arrangement of this patent provides reliable and accurate printer control, unfortunately, the optical sensor adds to the mass of the print head carriage and requires additional electrical connections to the print head carriage to conduct the signals generated by the optical sensor.

In the interest of further improving printing speed and performance, there is a need for an improved method and apparatus for monitoring the print head carriage of a printer. Preferably, the monitoring method and apparatus would provide accurate carriage position information without the addition of substantial mass to the print head carriage and without requiring any electrical connections to the print head carriage for the monitoring operations. Further, the monitoring method and apparatus would define at least one home position to facilitate operation of the printer.

SUMMARY OF THE INVENTION

This need is met by the method and apparatus of the present invention wherein a print head carriage is monitored by means of a timing member which is separate from but coupled to and movable in coordination with the carriage. The timing member is associated with the carriage drive motor and preferably is segmented and comprises a toothed wheel which is rotated by a motor drive gear also used to move the print head carriage. The teeth of the toothed wheel are monitored by an optical sensor with a resulting series of pulses being accumulated to define the rotation of the toothed wheel and thereby the movement and position of the print head carriage. A home carriage position is directly indicated via carriage position indicating means which is operated by the print head carriage to interrupt the optical sensor of the preferred embodiment. Preferably, the carriage position indicating means comprises a shutter member which interrupts the optical sensor whenever the print head carriage is in the home position.

In accordance with one aspect of the present invention, print head carriage monitoring apparatus for use in a printer comprises monitoring means separate from but coupled to and moveable in coordination with the carriage for generating an alternating signal indicating movement of the carriage. Carriage position indicating means are coupled to the monitoring means for interrupting the alternating signal when the carriage is in at least one defined position. The carriage includes control means for operating the carriage position indicating means when the carriage reaches the at least one defined position.

The monitoring means preferably comprises timing means having a plurality of spaced elements and sensor means for detecting the spaced elements. The timing means is separate from but coupled to and moveable with the carriage for indicating movement of the carriage via the sensor means which is positioned adjacent the timing means for detecting the presence of the spaced elements on the timing means.

In accordance with another aspect of the present invention, print head carriage monitoring apparatus for use in a printer comprises timing means comprising a plurality of spaced elements. The timing means is separate from but coupled to and moveable in coordination with the carriage for indicating movement of the carriage. Carriage position indicating means is provided and includes a sensed element for identifying at least one defined position of the carriage. The carriage includes control means for operating the carriage position indicating means when the carriage reaches the at least one defined position to move the sensed element of the carriage position indicating means. Sensor means is provided for detecting the presence of the plurality of spaced elements on the timing means and the sensed element.

Preferably, the timing means comprises a segmented member and the plurality of spaced elements comprises a plurality of spaced segments. In the preferred and illustrated embodiment, the spaced segments comprise teeth and the sensor means comprises an optical sensor with the teeth of the segmented member extending into and interrupting the optical sensor. For this configuration, the segmented member comprises a toothed wheel including an integral gear which is coupled to the carriage by an intermeshing gear of a carriage drive motor. When an optical sensor is used, the carriage position indicating means comprises shutter means for interrupting the optical sensor. The shutter means is resiliently biased away from the optical sensor and the control means of the print head carriage moves the shutter means into the optical sensor to interrupt the optical sensor when the carriage reaches the at least one defined position.

In the preferred embodiment, the optical sensor defines a gap through which the spaced teeth of the segmented member move during movement of the carriage. The shutter means is pivotally coupled to the optical sensor to be pivoted into and out of the gap of the optical sensor and includes an operating lever positioned to be engaged by the control means of the print head carriage. To make the print head carriage as compact and light as possible, the control means preferably comprises a projection extending from the carriage The shutter means comprises a shutter frame hingedly coupled to the optical sensor with the shutter frame defining spring means for resiliently biasing the shutter means away from the optical sensor. The shutter frame includes stop means for defining a retracted position of the shutter frame relative to the optical sensor, the shutter frame being resiliently biased to the retracted position by the spring means. Preferably, the shutter frame is constructed of plastic and the spring means comprises a leaf spring forming an integral part of the shutter frame. In the preferred embodiment, the defined position of the carriage is a home position.

In accordance with yet another aspect of the present invention, a method of monitoring a print head carriage of a printer comprises the steps of: coupling a timing member defining a plurality of spaced elements to the carriage, the timing member moving in correspondence with movement of the carriage; detecting the presence of the spaced elements of the timing member as they are moved relative to a sensor; and, moving a carriage position indicating member into a position to be sensed by the sensor to identify at least one position of the carriage.

In accordance with still another aspect of the present invention, a method of monitoring a print head carriage of a printer comprises the steps of: supporting a single sensor adjacent a defined position of the carriage; coupling a timing member comprising a plurality of spaced elements to the carriage such that the elements are sensed by the single sensor as the carriage is moved; coupling carriage position indicating means to the single sensor such that the carriage position indicating means is sensed by the single sensor whenever the carriage is in at least one defined position whereby both motion and positioning of the carriage in at least one defined position are detected by the single sensor.

In accordance with another aspect of the invention, a method of monitoring a print head carriage of a printer comprises the steps of: generating an alternating signal at a substantially fixed frequency upon movement of the carriage; and, halting the alternating signal upon movement of the carriage into a defined position. The method may further comprise the steps of: monitoring the alternating signal to maintain an estimate of the position of the carriage; and, indicating a carriage jam condition if the alternating signal is halted at a position other than the defined position. Preferably, the defined position corresponds to a print head carriage home position and the method further comprises the steps of: verifying the attainment of the home position by momentarily moving the carriage away from the home position; returning the carriage to the home position; and, monitoring the alternating signal during the foregoing two steps to ensure the carriage is not in a jam condition.

It is thus an object of the present invention to provide an improved method and apparatus for monitoring the print head carriage of a printer; to provide an improved method and apparatus for monitoring the print head carriage of a printer which accurately monitors the carriage position without adding substantial mass to the print head carriage and without requiring any electrical connections to the print head carriage for the monitoring operations; to provide an improved method and apparatus for monitoring the print head carriage of a printer by means of a timing member which is coupled to the carriage via a carriage drive motor and monitored via a sensor both of which are separate and apart from the carriage; and, to provide an improved method and apparatus for monitoring both the position and the motion of the print head carriage of a printer.

Other objects and advantages of the invention will be apparent from the following description, the accompanying drawings and the appended claims.

BRIEF DESCRIPTION OF THE DRAWINGS

FIG. 1 is a perspective view of print head carriage monitoring apparatus operable in accordance with the present invention;

FIG. 2 is an exploded view of a sensor assembly comprising a sensing support frame, an optical sensor and a carriage position sensing shutter shown in FIG. 1;

FIG. 5 is a graph of the electrical output signal generated by the optical sensor of the illustrated embodiment during movement of the print head carriage into and out of a home position.

DETAILED DESCRIPTION OF THE PRESENT INVENTION

Figure 3:
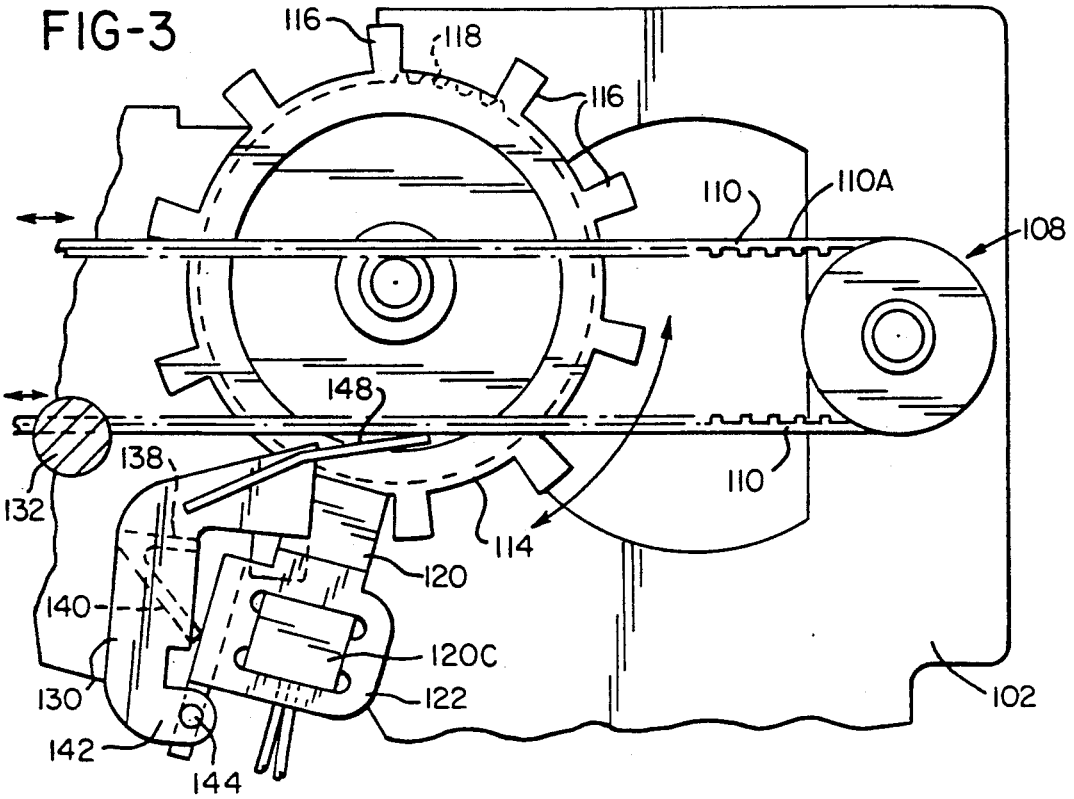
FIG. 3 is a plan view of the apparatus of FIG. 1 with the carriage position sensing shutter shown in its unoperated position.

While the present invention is generally applicable to the printing arts, it will be described with reference to a retail printer for which it is particularly applicable. A representative retail printer is illustrated, for example, by the printer disclosed in U.S. Pat. No. 4,989,487, which is incorporated herein by reference. With this understanding, reference will now be made to the drawing figures which illustrate the presently preferred embodiment of the present invention. For ease of illustration and description, only the portion of a retail printer which is related to the print carriage monitoring method and apparatus of the present invention is illustrated in the drawing figures.

FIG. 1 shows in perspective a broken away right end portion of a print carriage drive support plate 102. A print carriage stepper drive motor 104 is mounted beneath the plate 102. The motor 104 drives a spur gear 106 which drives directly or through other gear(s) a gear portion 108A of a timing belt support 108. The upper portion 108B of the support 108 drivingly engages a continuous timing belt 110 to which a print head carriage 112 is secured for reciprocal printing movement back and forth across the printer incorporating the print head carriage 112. Only the bottom of the print head carriage 112 is shown in dot-dash lines in FIG. 1 for clarity of illustration.

Figure 4:
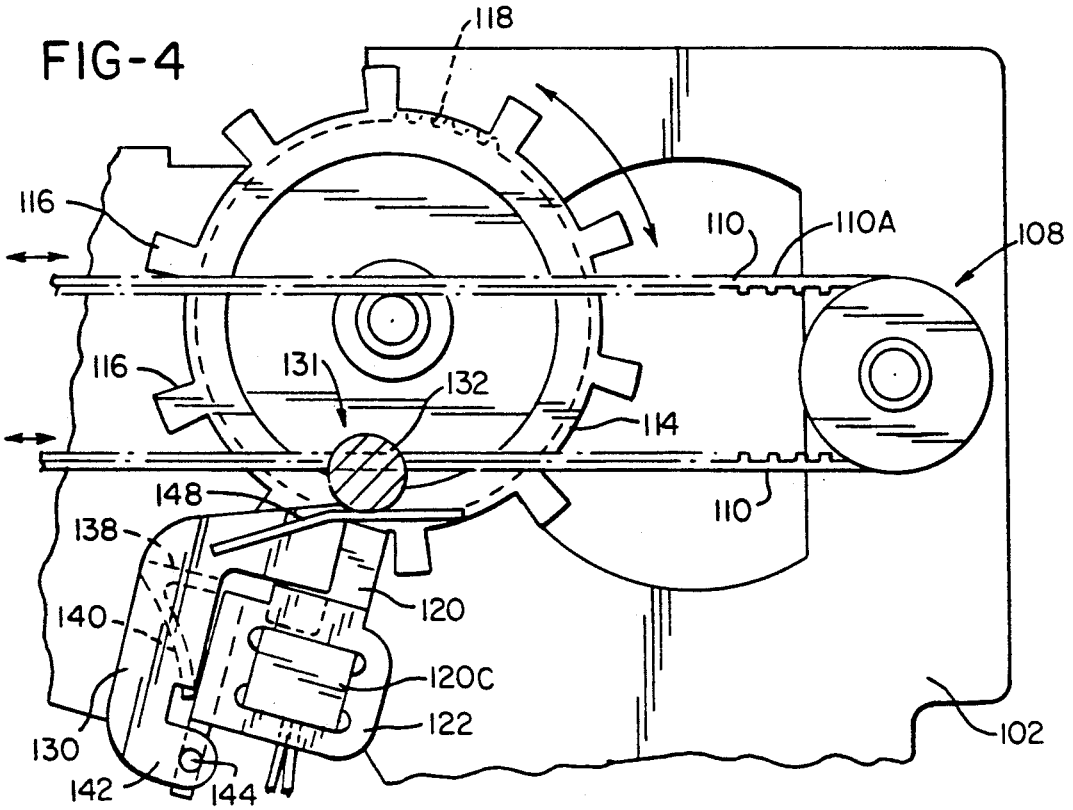
FIG. 4 is a plan view of the apparatus of FIG. 1 with the carriage position sensing shutter shown in its operated position.

The print head carriage monitoring apparatus of the present invention is associated with the motor 104 and timing belt 110 as shown in FIGS. 1, 3 and 4. In particular, monitoring means separate from but coupled to and moveable in coordination with the carriage 112 are provided for generating an alternating signal indicating movement of the carriage 112. In the preferred embodiment, the monitoring means comprises timing means defining a plurality of spaced elements with the timing means being separate from but coupled to and moveable in coordination with the carriage 112 for indicating movement of the carriage 112. The spaced elements are detected by sensor means to generate the alternating signal.

In the preferred and illustrated embodiment, the timing means comprises a segmented member or toothed wheel 114 having evenly spaced segments or teeth 116 extending radially therefrom. The toothed wheel 114 includes an integral gear 118 on its underside which is coupled to the carriage 112 by intermeshing with the spur gear 106 of the carriage stepper drive motor 104, see FIG. 1. Accordingly, the toothed wheel 114 is rotated whenever the drive motor 104 is operated to move the print head carriage 112 via the timing belt 110.

Sensor means is positioned adjacent the segmented member or toothed wheel 114 for detecting the presence of the segments or teeth 116 thereon. In the illustrated and preferred embodiment, the sensor means comprises an optical sensor 120 defining a gap 121 into which the teeth 116 of the toothed wheel 114 extend and thereby interrupt the optical sensor 120. The optical sensor 120 comprises the combination of a light emitting diode (LED) and light sensor which is commercially available in the generally U-shaped package shown in FIGS. 1 and 2. The LED is located in one leg 120A of the U-shaped package and the light sensor is located in the other leg 120B. Thus, as the toothed wheel 114 is rotated in coordination with the movement of the print head carriage 112, light generated by the LED and passing to the optical sensor 120 is interrupted by the teeth 116 to generate a series of pulses as shown in FIG. 5 as will be described hereinafter. The pulses are monitored in a manner similar to that of the above referenced patent to determine the position of the carriage 112 and to verify commanded movement of the carriage 112 or lack of commanded movement indicating a jam condition.

While the toothed wheel 114 and optical sensor 120 are preferred for the present invention, it should be apparent that other timing means could be utilized with either other sensors or the optical sensor 120. For example, the segments could be sensed by a proximity sensor or the timing means could comprise a wheel having a plurality of magnets in its outer periphery with the magnets being sensed by a Hall effect sensor. In view of this disclosure, still other timing means and sensor means will surely be suggested to those skilled in the art.

The optical sensor 120 is supported upon the print carriage drive support plate 102 by a support frame 122 best shown in FIG. 2. The support frame 122 includes generally rectangular apertures 124 for frictionally receiving mounting tabs 120C of the optical sensor 120. Preferably, the support frame 122 is formed of a plastic material for light weight and to facilitate insertion of the optical sensor 120 therein. The support frame 122 includes a mounting tab 126 having an aperture 128 therethrough for securing the support frame 122 to the plate 102 by means of a pin, screw, rivet or other appropriate fastener device.

In addition to being able to monitor the position of the print head carriage 112 by means of accumulating or counting the pulses generated by the optical sensor 120, the print head monitoring method and apparatus of the present invention further provides for detecting the positioning of the print head carriage 112 in at least one defined position. To this end, carriage position indicating means are provided for activating the optical sensor 120 whenever the carriage 112 is in the at least one defined position. In the illustrated and preferred embodiment of the present invention, the defined position is the home position 131 of the carriage 112 at the right side of the plate 102 as shown in FIG. 4. It will become apparent that additional positions of the print head carriage 112 could be defined by simple modifications of the carriage position sensing means. The carriage position indicating means comprises shutter means taking the form of a shutter frame 130, see FIG. 2. The carriage 112 includes control means taking the form of a stud 132 extending downwardly from the carriage 112 for operating the carriage position indicating means when the carriage 112 reaches the home position 131.

The shutter frame 130 is hingedly coupled to the optical sensor 120 by means of the optical sensor support frame 122 and defines spring means for resiliently biasing the shutter means away from the optical sensor 120. As best shown in FIG. 2, the shutter frame comprises an upper plate 134 and a lower plate 136. The upper and lower plates 134, 136 are interconnected by a first rib 138 which is fixedly secured therebetween. The spring means comprises a second rib or leaf spring 140 which forms an integral part of the shutter frame 130. However, the upper and lower portions of the leaf spring 140 are not fixedly secured to the upper and lower plates 134, 136 but are slightly spaced therefrom and movable relative thereto to perform the biasing operation of the spring means. Movement of the leaf spring 140 relative to the upper and lower plates 134, 136 is evident by reviewing its different positions in FIGS. 3 and 4 and noting the slight bend of the leaf spring 140 in FIG. 4.

The shutter frame 130 includes a pair of hinge brackets 142 which receive hinge pins 144 formed on the optical sensor support frame 122. To stabilize and properly position the shutter frame 130 relative to the sensor support frame 122, the shutter frame 130 defines stop means for defining a retracted position of the shutter frame relative to the optical sensor 120. The stop means comprises a tab 146 which engages the optical sensor support frame 122 when the shutter frame 130 is resiliently biased to its retracted position by the leaf spring 140.

The lower plate 136 includes a sensed element or true shutter portion 136A or carriage 112 position indicating member which is inserted into and interrupts the sensing gap 121 of the optical sensor 120 each time the print head carriage 112 is moved to the home position 131 shown in FIG. 4. The shutter portion 136A is pivoted into and out of the sensing gap 121 of the optical sensor 120 by an operating lever 148 which is positioned to be engaged by control means, i.e. the stud 132 extending downwardly from the print head carriage 112 as shown in FIGS. 1, 3 and 4. The operating lever 148 is secured to and cantilever supported from the upper plate 138. Preferably, the shutter frame 130 is formed of a plastic material for reduced weight and to facilitate assembly of the shutter frame 130 to the optical sensor support frame 122. Additional positions of the print head carriage 112 could be defined by coupling additional activating studs to the timing belt 110. The identification of additional positions could also require extension of the operating lever 148 if operating studs are located along the forward side 110A of the timing belt 110.

While operation of the present invention should be apparent from the foregoing description of the illustrative and preferred apparatus, methods of monitoring a print head carriage in accordance with the present invention will now be described. The print head carriage 112 of a printer is monitored in accordance with the present invention by performing the following steps: coupling a timing member defining a plurality of spaced elements to the carriage 112; moving the timing member in correspondence with movement of the carriage 112; positioning a sensor 120 adjacent to the timing member; detecting the presence of the spaced elements of the timing member as they are moved relative to the sensor 120; and, moving a carriage position indicating member into a position to be sensed by the sensor 120 to identify at least one position of the carriage 112. The method is performed using a single sensor, e.g. the sensor 120, which is positioned adjacent a defined position of the carriage 112 such that both motion and positioning of the carriage 112 in at least one defined position are detected by the single sensor 120.

In its broadest aspect, the method of monitoring a print head carriage of a printer in accordance with the present invention comprises the steps of: generating an alternating signal at a substantially fixed frequency upon movement of the carriage 112; and, halting the alternating signal upon movement of the carriage 112 into a defined position. To properly control the movement of the carriage 112, the method preferably further comprises the steps of: monitoring the alternating signal to maintain an estimate of the position of the carriage 112; and, indicating a carriage jam condition if the alternating signal is halted at a position other than the defined position.

If the print head carriage 112 is to remain in the defined position or home position 131 in the illustrated embodiment, the method also preferably verifies the attainment of the home position 131 by momentarily moving the carriage 112 away from the home position 131 and then returning the carriage 112 to the home position 131. For home position verification, the print head carriage 112 is controlled as if for printing to move the carriage 112 away from the home position 131 a sufficient distance to generate at least one alternation in the alternating signal and then returned to the home position 131. The alternating signal is monitored during this "jiggle" of the carriage 112 to ensure the carriage 112 is indeed in the home position 131 and has not become jammed.

The electrical output signal 150 generated by the optical sensor 120 during movement of the print head carriage 112 into and out of the home position 131 is shown in FIG. 5. As shown in FIG. 5, the home position 131 of the print head carriage 112 is centered upon the extended pulse 152 which is created by the interruption of the optical sensor 120 by the shutter frame 130 caused by the stud 132 engaging the operating lever 148 of the shutter frame 130. The evenly spaced pulses to the left of the extended pulse 152 are generated by movement of the print head carriage 112 from left to right as shown in FIGS. 1, 3 and 4. After the home position 131 is identified by the extended pulse 152, the print head carriage 112 is moved in the reverse direction, i.e. from right to left, which movement is represented by the evenly spaced pulses to the right of the extended pulse 152.

If the print head carriage 112 is to remain in the home position 131, the print head carriage 112 is controlled as if for printing to move the carriage 112 to the left or out of the home position 131 a sufficient distance to generate at least one alternation in the alternating signal generated by the sensor 120 and then the carriage 112 is returned to the home position 131. Of course, the accumulation of pulses indicates to a controller of the printer that the home position 131 has been attained, but the "jiggle" of the print head carriage 112 is performed to ensure a jam has not occurred and for positive verification of the positioning of the print head carriage 112 in the home position 131.

Having thus described the method and apparatus for monitoring a print head carriage of the present invention in detail and by reference to preferred embodiments thereof, it will be apparent that modifications and variations are possible without departing from the scope of the invention defined in the appended claims.

What is claimed is:

1. Print head carriage monitoring apparatus for use in a printer including a print head carriage, said apparatus comprising:

monitoring means separate from but moveable in coordination with the carriage and including single sensor means for generating an alternating signal indicating movement of the carriage; and carriage position indicating means coupled to said monitoring means for activating said monitoring means to interrupt said alternating signal when the carriage is in at least one defined position, the carriage including control means for operating said carriage position indicating means when the carriage reaches said at least one defined position.

2. Print head carriage monitoring apparatus for use in a printer as claimed in claim 1 wherein said monitoring means comprises:

timing means comprising a plurality of spaced elements, said timing means being separate from but moveable in coordination with the carriage for indicating movement of the carriage; and wherein said single sensor means is positioned adjacent said timing means for detecting the presence of the spaced elements on said timing means for generating said alternating signal.

3. Print head carriage monitoring apparatus for use in a printer as claimed in claim 2 wherein said carriage position indicating means activates said sensor means when the carriage is in said at least one defined position.

4. Print head carriage monitoring apparatus for use in a printer as claimed in claim 2 wherein said timing means comprises a segmented member and said plurality of spaced elements comprises a plurality of spaced segments, said segmented member being separate from but coupled to and moveable in coordination with the carriage for indicating movement of the carriage.

5. Print head carriage monitoring apparatus for use in a printer as claimed in claim 4 wherein said segments comprise teeth and said sensor means comprises an optical sensor defining a gap across which light passes with the teeth of said segmented member extending into said gap and thereby interrupting said optical sensor.

6. Print head carriage monitoring apparatus for use in a printer as claimed in claim 5 wherein said segmented member comprises a toothed wheel coupled to the carriage.

7. Print head carriage monitoring apparatus for use in a printer as claimed in claim 6 wherein said printer comprises a carriage drive motor for moving said print head carriage and a drive gear connected to said carriage drive motor, and said toothed wheel comprises a gear which is coupled to the carriage by intermeshing with said drive gear.

8. Print head carriage monitoring apparatus for use in a printer as claimed in claim 5 wherein said carriage position indicating means comprises shutter means for interrupting said optical sensor, said shutter means being resiliently biased away from said optical sensor and said control means moving said shutter means into said gap of said optical sensor to interrupt said optical sensor when the carriage reaches said at least one defined position.

9. Print head carriage monitoring apparatus for use in a printer as claimed in claim 8 wherein said optical sensor defines a gap through which the spaced teeth of said segmented member move during movement of the carriage, said shutter means being pivotally coupled to said optical sensor to be pivoted into and out of said gap and including an operating lever positioned to be engaged by said control means.

10. Print head carriage monitoring apparatus for use in a printer as claimed in claim 9 wherein said control means comprises a projection extending from the carriage.

11. Print head carriage monitoring apparatus for use in a printer as claimed in claim 10 wherein said shutter means comprises a shutter frame hingedly coupled to said optical sensor, said shutter frame defining spring means for resiliently biasing said shutter means away from said optical sensor.

12. Print head carriage monitoring apparatus for use in a printer as claimed in claim 11 wherein said support frame includes stop means for defining a retracted position of said shutter means relative to said optical sensor, said shutter means being resiliently biased to said retracted position by said spring means.

13. Print head carriage monitoring apparatus for use in a printer as claimed in claim 12 wherein said shutter frame is constructed of plastic and said spring means comprises a leaf spring forming an integral part of said shutter frame.

14. Print head carriage monitoring apparatus for use in a printer as claimed in claim 13 wherein said defined position of the carriage is a home position.

15. Print head carriage monitoring apparatus for use in a printer, said apparatus comprising:

timing means comprising a plurality of spaced elements, said timing means being separate from but moveable in coordination with the carriage for indicating movement of the carriage;

carriage position indicating means including a carriage position defining element for identifying at least one defined position of the carriage, the carriage including control means for operating said carriage position indicating means when the carriage reaches said at least one defined position to move said carriage position defining element; and single sensor means for detecting the presence of said spaced elements on said timing means and said carriage position defining element.

16. Print head carriage monitoring apparatus for use in a printer as claimed in claim 15 wherein said timing means comprises a segmented member and said plurality of spaced element comprises a plurality of spaced segments, said segmented member being separate from but moveable in coordination with the carriage for indicating movement of the carriage.

17. Print head carriage monitoring apparatus for use in a printer as claimed in claim 16 wherein said plurality of spaced segments comprises a plurality of spaced teeth and said sensor means comprises a single optical sensor defining a gap across which light passes with the plurality of spaced teeth of said segmented means and the carriage position defining element of said carriage position indicating means extending into said gap and thereby interrupting said optical sensor.

18. Print head carriage monitoring apparatus for use in a printer as claimed in claim 17 wherein said segmented member comprises a toothed wheel moved in coordination with the carriage.

19. Print head carriage monitoring apparatus for use in a printer as claimed in claim 18 wherein said printer comprises a carriage drive motor for moving said print head carriage and a drive gear connected to said carriage drive motor, and said toothed wheel comprises a gear which is coupled to the carriage by intermeshing with said drive gear.

20. Print head carriage monitoring apparatus for use in a printer as claimed in claim 19 wherein said at least one defined position corresponds to a home position of the carriage.

21. A method of monitoring a print head carriage of a printer comprising the steps of:

coupling a timing member defining a plurality of spaced elements to the carriage;

moving said timing member in correspondence with movement of the carriage;

positioning a single sensor adjacent to said timing member;

detecting the presence of the spaced elements of said timing member as they are moved relative to said single sensor; and moving a carriage position indicating member into a position to be sensed by said single sensor to identify at least one position of the carriage.

22. A method of monitoring a print head carriage of a printer comprising the steps of:

supporting a single sensor adjacent a defined position of the carriage;

coupling a timing member comprising a plurality of spaced elements to the carriage such that said elements are sensed by said single sensor as the carriage is moved; and coupling carriage position indicating means to said single sensor such that said carriage position indicating means is sensed by said single sensor whenever the carriage is in at least one defined position whereby both motion and positioning of the carriage in at least one defined position are detected by said single sensor.

23. A method of monitoring a print head carriage of a printer comprising the steps of:

coupling a movement indicating element to the carriage such that the movement indicating element moves in coordination with the carriage;

supporting a single sensor adjacent to said movement indicating element, said sensor monitoring said movement indicating element to generate an alternating signal at a substantially fixed frequency upon movement of the carriage; and activating said sensor to the alternating signal upon movement of the carriage into a defined position.

24. A method of monitoring a print head carriage of a printer as claimed in claim 23 further comprising the steps of:

monitoring said alternating signal to maintain an estimate of the position of the carriage; and indicating a carriage jam condition if said alternating signal is halted at a position other than said defined position.

25. A method of monitoring a print head carriage of a printer as claimed in claim 23 wherein said defined position corresponds to a carriage home position and said method further comprises the steps of:

verifying the attainment of said home position by momentarily moving the carriage away from said home position;

returning the carriage to said home position; and monitoring said alternating signal during the foregoing two steps to ensure the carriage is not in a jam condition.

* * * * *